United States Patent [19]

Eftefield et al.

[11] 4,086,967

[45] May 2, 1978

[54] EXTENDED LIFE END BITS FOR BULLDOZER BLADES

[75] Inventors: Larry G. Eftefield; Paul J. Lukavich; Roger R. Mitchell, all of Joliet, Ill.

[73] Assignee: Caterpillar Tractor Co., Peoria, Ill.

[21] Appl. No.: 697,080

[22] Filed: Jun. 16, 1976

[51] Int. Cl.[2] ..... E02F 3/76; E02F 3/80

[52] U.S. Cl. ..... 172/777; 37/141 T; 172/719; 172/735; 172/737

[58] Field of Search ..... 172/702, 703, 704, 719, 172/735, 737, 777, 767; 37/141 R, 141 T, 142 R, 142 A

[56] References Cited

U.S. PATENT DOCUMENTS

| | | | |
|---|---|---|---|
| 2,831,275 | 4/1958 | Kimsey et al. | 37/141 T |
| 2,965,989 | 12/1960 | Hibbard | 172/777 |
| 3,289,331 | 12/1966 | Freeman | 172/777 |
| 3,638,736 | 2/1972 | Hahn | 172/719 |
| 3,994,084 | 11/1976 | Smith et al. | 37/141 R |

FOREIGN PATENT DOCUMENTS

| | | | |
|---|---|---|---|
| 744,115 | 11/1966 | Canada | 172/719 |
| 541,626 | 4/1956 | Italy | 37/141 R |
| 160,047 | 1/1964 | U.S.S.R. | 172/719 |

*Primary Examiner*—Richard T. Stouffer

*Attorney, Agent, or Firm*—Wegner, Stellman, McCord, Wiles & Wood

[57] ABSTRACT

An end bit for selective and adjustable mounting to an earthmoving vehicle structure, such as a bulldozer blade, having opposite corner portions. The bit includes transversely extending cutting edge portions and a mounting portion adapted to be selectively mounted to either of the opposite corners of the blade with one or the other of the cutting edges exposed in cutting position and with the nonexposed cutting edge disposed in a retracted position. The mounting portion is further adapted to permit the bit to be selectively repositioned on either blade corner portion in any one of a plurality of different extended positions to compensate for wear of the exposed cutting edge.

1 Claim, 7 Drawing Figures

EXTENDED LIFE END BITS FOR BULLDOZER BLADES

BACKGROUND OF THE INVENTION

1. Field of the Invention

This invention relates to earthworking apparatus and, in particular, to cutting bits for installation on a blade of such apparatus.

2. Description of the Prior Art

In U.S. Pat. No. 2,965,989, issued to M. R. Hubbard, the use of forwardly repositionable end bits for earth-moving equipment is disclosed. The Hubbard bits include a number of bolt mounting holes in excess of the minimum number required to mount the bit to the blade. This arrangement allows the bit to be selectively remounted to the blade as the cutting edge of the bit is worn away, thereby extending the useful life of the bit. The Hubbard bit is arranged to be mounted on only one or the other of the opposite corners of a blade.

In U. S. patent application Ser. No. 665,731, now U.S. Pat. No. 4,044,481, owned by the assignee of the present application, Eftefield and Lukavich disclose an end bit comprising two cutting edges extending transversely to each other and a mounting portion located between the cutting edges, the mounting portion adapted to be mounted to each of the opposite corner portions of an earthmoving blade with one or the other of the cutting edges exposed in cutting position with the remaining cutting edge in retracted position. The bit is positionable in only a single position of extension on each blade corner portion.

SUMMARY OF THE INVENTION

One object of the present invention is to provide an end bit for earthmoving blades, such as bulldozer blades, that is not only reversibly mountable to each of the opposite corner portions of the blade, but is also respositionable so as to compensate for wear of the cutting edge.

The bit is provided with two cutting edges extending transversely to each other, and a mounting portion. The mounting portion includes improved means for mounting the bit to each corner of the blade in any one of a plurality of different extended positions to compensate for wear of the cutting edges.

In the illustrated blade end bit, the mounting portion defines a plurality of bolt mounting holes suitable for alignment with a second plurality of bolt mounting holes in the blade corner portions, the number of holes in each bit exceeding the number of holes located in each of the corner portions of the blade, thereby allowing the bit to be selectively remounted on the blade corner portion as the forwardly extending cutting edge is worn away.

Other features and advantages of the invention will become apparent from the following specification taken in connection with the accompanying drawings.

BRIEF DESCRIPTION OF THE DRAWINGS

The details of construction and operation of the invention are more fully described with reference to the accompanying drawings which form a part hereof and in which like reference numerals refer to like parts throughout.

DESCRIPTION OF THE PREFERRED EMBODIMENT

Figure 1:
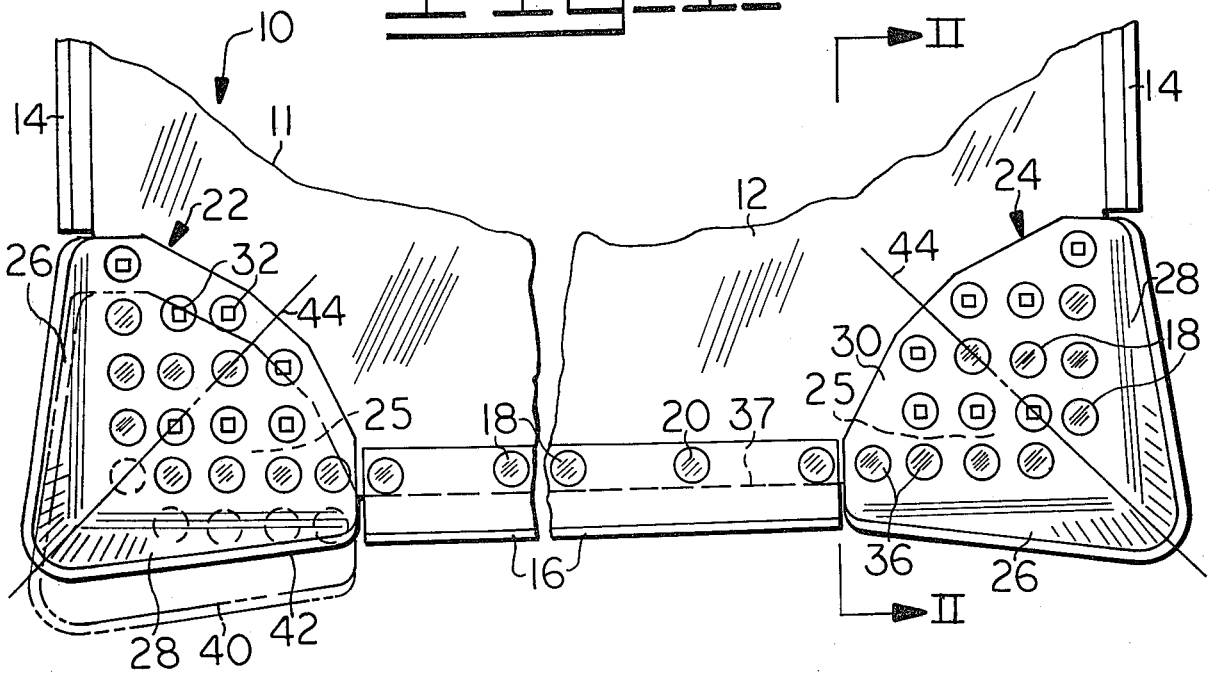
FIG. 1 is a fragmentary front view of an earth-moving blade utilizing end bits embodying the invention, and showing one bit in an extended position in phantom lines.

Referring to FIG. 1, an earth-moving element 10, illustratively comprising a bulldozer blade, defines end portions 11 and 12. The blade is equipped with side and bottom cutting edge segments 14 and 16. The cutting edge segments provide a cutting action dislodging earth materials from the underlying terrain. The bottom cutting edge segments 16, as shown in FIG. 1, are secured to blade end portions 11 and 12 by mounting bolts 18 which extend through mounting holes 20 in the cutting edge segment 16 and the blade end portions. This arrangement allows a worn or broken cutting edge segment 16 to be readily removed and replaced.

Figure 2:
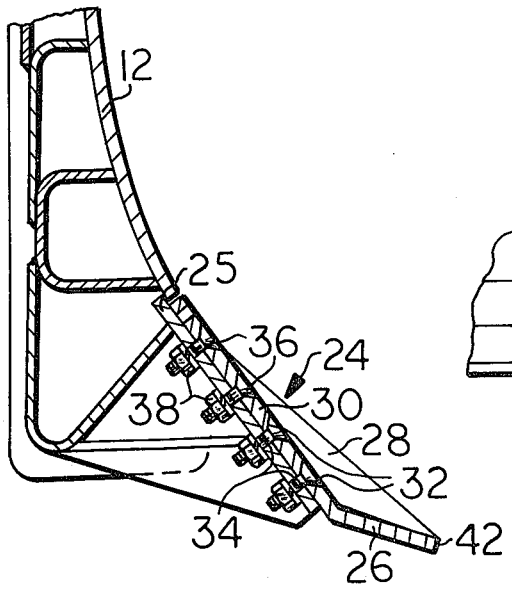
FIG. 2 is a cross-sectional side view taken substantially along 2—2 of FIG. 1.

As illustrated in FIG. 1, end bits 22 and 24 are mounted on opposite corners 25 of blade end portions 11 and 12, respectively. Each end bit includes a first cutting edge portion 26 and second cutting edge portion 28, the cutting edge portions being disposed transversely to each other. Referring to FIG. 2, it may be noted that the cutting edges 26 and 28 extend angularly forwardly from the edges of mounting portion 30 extending between the cutting edge portions 26 and 28.

The mounting portion 30, as shown in FIGS. 1 and 2, comprises a flat portion. Mounting portion 30 is provided with means for securing the end bit to a corner portion 25 of end portion 11 or 12, which in the illustrated embodiment comprises a plurality of mounting holes 32 as shown in FIG. 1. A second plurality of mounting holes 34 is disposed in each corner portion 25 of blade end portions 11 and 12, as illustrated in FIG. 2. The end bits may be secured to blade end portions 11 and 12 by means of bolts 36 extended through mounting holes 32 and 34, and secured by suitable fastening means such as nuts 38.

As shown in FIG. 1, bit bolt mounting holes 32 are disposed in perpendicularly related rows. The blade bolt mounting holes 34 are disposed in rows extending parallel to the leading surface of the blade, shown by dotted line 37. As a result, at least a portion of any row of bit bolt mounting holes 32 may be aligned with any row of blade bolt mounting holes 34. Such an arrangement allows the end bit 22 or 24 to be mounted on the corner of the blade end portion 11 or 12 in any one of a plurality of positions with the lower cutting edge exposed forwardly of the blade 10.

More specifically, referring to FIG. 1, end bit 22 may be mounted on the corner portion 25 of end portion 11 in a forward position 40, shown by dotted lines in FIG. 1. Repositioning of the end bit 22 or 24 after the front edge 42 of cutting edge 28 or 26 is worn away by earth-moving service is effected by selective remounting of the bit 22 or 24, so as to re-expose the end of the cutting edge forwardly of the blade end portion.

Figure 3:
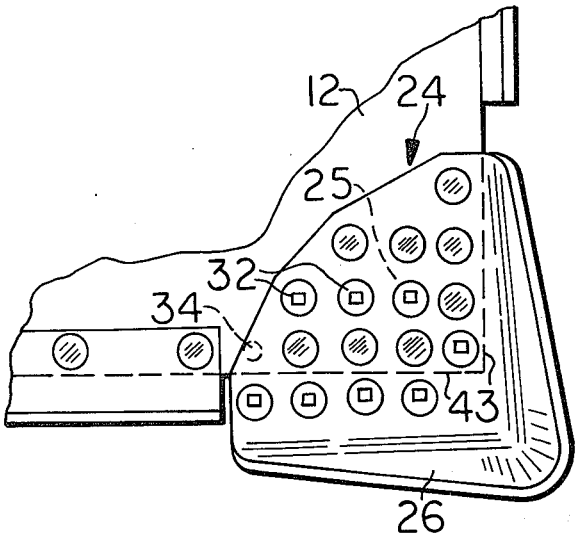
FIG. 3 is a fragmentary front view of an earth-moving blade showing an end bit in an extended position, and illustrating the selective alignment of bolt mounting holes in the bit and in the blade.

FIG. 3 shows end bit 24 mounted on corner portion 25 of blade end portion 12 in an original position wherein the cutting edge portion 26 is exposed forwardly of the position shown in FIG. 1. Repositioning is accomplished by means of selective realignment of bit bolt mounting holes 32 with blade bolt mounting holes 34.

Figure 4:
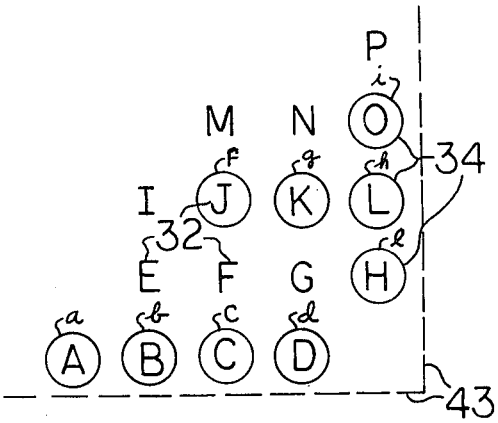
FIG. 4 is a schematic representation of the alignment of bit bolt mounting holes and blade bolt mounting holes with the bit mounted in an original position on one end portion of an earth-moving blade, with the edge of the blade end portion shown in phantom lines.
Figure 5:
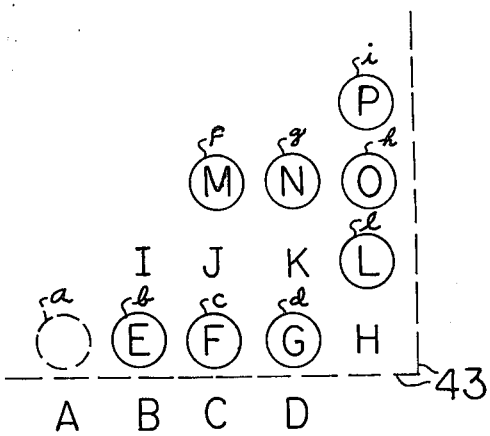
FIG. 5 is a schematic representation of the alignment of bit bolt mounting holes and blade bolt mounting holes with the bit of FIG. 4 repositioned in an extended position.

FIGS. 4 and 5 provide an illustration of the preferred embodiment utilizing selective alignment of bolt holes to effect selective positioning of end bit 24. The letters A–P in FIGS. 4 and 5 represent respectively the bolt mounting hole positions in end bit 24. The circles *a–i* represent the bolt mounting holes 34 found in blade end portion 12. Dotted line 43 represents the edge of blade 10. FIG. 4 represents the end bit 24 mounted on blade end portion 12 in an original position. In this position, the bit member bolt mounting holes 32 are aligned with the blade bolt mounting holes 34 in the following manner:

| Bit Member Bolt Mounting Hole | aligned with | Blade Bolting Mounting Hole |
|---|---|---|
| A | — | a |
| B | — | b |
| C | — | c |
| D | — | d |
| H | — | e |
| J | — | f |
| K | — | g |
| L | — | h |
| O | — | i |

FIG. 5 represents the end bit represented in FIG. 4 remounted to an extended position as shown in FIG. 3 with the forward cutting edge redisposed forwardly of the edge 43 of the blade. In this position, the bolt mounting holes 32 and 34 are aligned in the following fashion:

| Bit Member Bolt Mounting Hole | aligned with | Blade Bolt Mounting Hole |
|---|---|---|
| E | — | b |
| F | — | c |
| G | — | d |
| L | — | e |
| M | — | f |
| N | — | g |
| O | — | h |
| P | — | i |

In addition to being selectively forwardly repositionable, the end bit 22 (or, alternatively, 24) is adapted to be mounted on the corner portion 25 of either of the blade end portions 11 or 12. Thus, in the preferred embodiment, the array of bit bolt mounting holes 32 on mounting portion 30 is symmetrical about the centerline 44 bisecting the angle made by the intersection of the cutting portions 26 and 28 on end bit 22 (see FIG. 1). Thus, by a 90° counterclockwise rotation of end bit 22, end bit 22 may be disposed in the position of end bit 24 in FIG. 1 to be mounted on the corner portion 25 of blade end portion 12.

Figure 6:
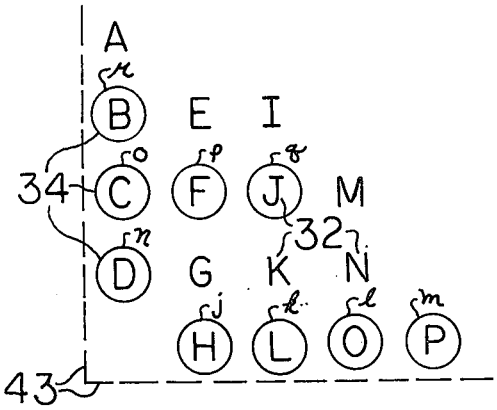
FIG. 6 is a schematic representation of the alignment of bit bolt mounting holes and blade bolt mounting holes with the bit of FIG. 4 mounted in an original position on the opposite blade end portion.
Figure 7:
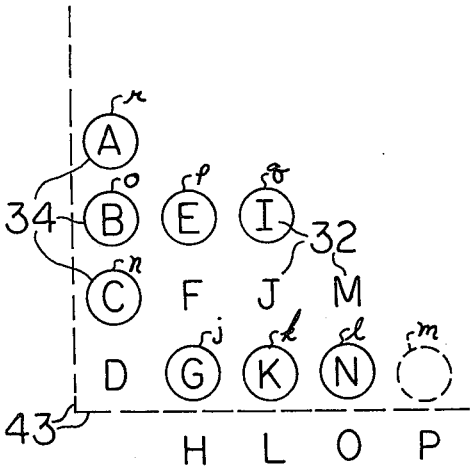
FIG. 7 is a schematic representation of the alignment of bit bolt mounting holes and blade bolt mounting holes with the bit of FIG. 6 repositioned in an extended position.

FIGS. 6 and 7 represent the alignment of bolt holes 32 and 34 on end bit 24 after it has been rotated and transferred to blade end portion 11 in the original position of end bit 22 shown in FIG. 1. In FIGS. 6 and 7, the letters A–P represent bit member bolt mounting holes 32, as in FIGS. 4 and 5, while letters *j–r* represent blade bolt mounting holes 34. In FIG. 6, the end bit is positioned in the original transferred position with the bit member bolt mounting holes being aligned with blade bolt mounting holes in the following fashion:

| Bit Member Bolt Mounting Hole | aligned with | Blade Bolt Mounting Hole |
|---|---|---|
| B | — | r |
| C | — | o |
| D | — | n |
| F | — | p |
| H | — | j |
| J | — | q |
| L | — | k |
| O | — | l |
| P | — | m |

FIG. 7 represents end bit 22 repositioned such that the bit is in a forwardly extended position. The bolt mounting holes 32 and 34 are aligned as follows:

| Bit Member Bolt Mounting Hole | aligned with | Blade Bolt Mounting Hole |
|---|---|---|
| A | — | r |
| B | — | o |
| C | — | n |
| E | — | p |
| G | — | j |
| I | — | q |
| K | — | k |
| N | — | l |

From the foregoing it is evident that the described invention provides an end bit for use on earth-moving vehicle structures which displays the desirable attributes of ease of mounting and economy of operation by virtue of its extended useful life.

What is claimed is:

1. A reversible end bit for selective mounting to an earthworking blade having opposite corner portions, said bit comprising a one-piece rigid member having a first cutting edge portion, a second cutting edge portion extending transversely to said first cutting edge portions, and a mounting portion included between said cutting edge portions and adapted to be mounted to one corner portion of a blade with said mounting portion facially abutting the blade and said first cutting edge portion in forwardly projecting cutting position, and to the opposite corner portion of the blade with said mounting portion turned approximately 90° and facially abutting the blade and the second cutting edge portion in forwardly projecting cutting position, said bit member being substantially symmetrical about a centerline bisecting the angle defined by said cutting edge portions and said mounting portion, said bit member mounting portion defining a plurality of bolt mounting holes arranged in a preselected pattern symmetrically of said centerline, each of said blade corner portions defining a plurality of bolt mounting holes arranged in a preselected pattern symmetrically of said centerline, each of said blade corner portions defining a plurality of bolt mounting holes arranged in a pattern preselected to have a first portion thereof aligned with a first group of said bit mounting holes with the bit member disposed in a first adjusted position on one of said blade corner portions, a second portion thereof aligned with a second group of said bit mounting holes with the bit member disposed in a second adjusted position on said one of said blade corner portions, a third portion thereof aligned with a third group of said bit mounting holes with the bit member disposed in a third adjusted position on the other of said blade corner portions, and a fourth portion thereof aligned with a fourth group of said bit mounting holes with the bit member disposed in a fourth adjusted position on said other of said blade corner portions, said bit bolt mounting holes being arranged in a rectangular grid pattern defined by horizontal and vertical rows extending from a holeless corner position with the first horizontal row having bolt mounting holes in each of the second, third, fourth and fifth vertical rows, the second horizontal row having bolt mounting holes in each of the first, second, third and fourth vertical rows, the third horizontal row having bolt mounting holes in each of the first, second, third and fourth vertical rows, said fourth horizontal row having bolt mounting holes in each of the first, second, and third vertical rows, and said fifth horizontal row having a bolt mounting hole in the first vertical row.

* * * * *